US011552410B2

(12) United States Patent
Meyer

(10) Patent No.: US 11,552,410 B2
(45) Date of Patent: Jan. 10, 2023

(54) ANTENNA MODULE AND MASSIVE MIMO ANTENNA

(71) Applicant: XILINX, INC., San Jose, CA (US)

(72) Inventor: Peter Meyer, Dresden (DE)

(73) Assignee: XILINX, INC., San Jose, CA (US)

( * ) Notice: Subject to any disclaimer, the term of this patent is extended or adjusted under 35 U.S.C. 154(b) by 0 days.

(21) Appl. No.: 17/257,137

(22) PCT Filed: Jul. 24, 2019

(86) PCT No.: PCT/EP2019/069907
§ 371 (c)(1),
(2) Date: Dec. 30, 2020

(87) PCT Pub. No.: WO2020/020941
PCT Pub. Date: Jan. 30, 2020

(65) Prior Publication Data

US 2021/0367353 A1 Nov. 25, 2021

(30) Foreign Application Priority Data

Jul. 27, 2018 (EP) ..... 18185977

(51) Int. Cl.

| | |
|---|---|
| ***H01Q 21/00*** | (2006.01) |
| ***H01Q 3/24*** | (2006.01) |
| ***H01Q 3/30*** | (2006.01) |
| ***H01Q 21/28*** | (2006.01) |

(52) U.S. Cl.
CPC ..... *H01Q 21/0006* (2013.01); *H01Q 3/24* (2013.01); *H01Q 3/30* (2013.01); *H01Q 21/28* (2013.01)

(58) Field of Classification Search
CPC ..... H01Q 21/00; H01Q 3/24; H01Q 3/30; H01Q 21/28
See application file for complete search history.

(56) References Cited

U.S. PATENT DOCUMENTS 5,167,510 A 12/1992 Plummer
2015/0215024 A1* 7/2015 Nilsson ..... H04B 7/0617 375/267

FOREIGN PATENT DOCUMENTS

CN 108063318 A 5/2018

OTHER PUBLICATIONS

International Search Report and Written Opinion from PCT/EP2019/069907 dated Sep. 16, 2019.

* cited by examiner

*Primary Examiner* — Andrea Lindgren Baltzell
(74) *Attorney, Agent, or Firm* — Patterson + Sheridan, LLP

(57) ABSTRACT

The present invention provides an antenna module for a massive MIMO antenna, the antenna module comprising a plurality of first signal ports, a number of first antenna elements arranged in a first matrix arrangement, wherein a number of rows of the first matrix arrangement and/or a number of columns of the first matrix arrangement equals the number of first signal ports, and a switching matrix that is configured to controllably couple each of the first signal ports either with all first antenna elements of a respective row of the first matrix arrangement or all first antenna elements of a respective column of the first matrix arrangement. Further, the present invention provides a respective massive MIMO antenna.

20 Claims, 11 Drawing Sheets

100

200

100

200

500

500

500

620

ANTENNA MODULE AND MASSIVE MIMO ANTENNA

TECHNICAL FIELD

The invention relates to an antenna module and a respective massive MIMO antenna.

BACKGROUND

Although applicable to any wireless communication system, the present invention will mainly be described in conjunction with massive MIMO antennas that comprise multiple antenna elements.

Today wireless communication networks are widely used for providing voice and data communication to users. Such wireless communication networks, like e.g. LTE based or so-called 4G networks, usually comprise a core network and a so-called radio access network or RAN. It is understood, that each of these interrelated networks may comprise a plurality of different elements, modules or units that together provide the required communication capabilities.

As part of the RAN so called eNodeBs or base stations provide the link between the operator's network and the users mobile devices or user equipments (UEs). Usually the eNodeBs will comprise antennas that serve for transmitting outgoing signals to the UEs and for receiving incoming signals from the UEs. Up to now, most commonly passive or active antennas with fixed radiation patterns are used.

However, in the future, especially in modern 5G-Networks, such conventional antennas may be replaced by massive MIMO antennas (antennas with a plurality of single antenna elements that may form and steer a plurality of beams at the same time).

For the best beamforming capabilities each antenna element should be connected to its own transceiver in a massive MIMO antenna. This allows manipulating the digital signal, e.g. phase-shifting, before the transceiver to allow beamforming. If the distance of the antenna elements is half the wavelength of the transmitted or received signal, it is possible to create a beam in arbitrary directions. However, transceivers and their corresponding front end elements are very complex and expensive.

For that reason, it is common to combine two concurrent or neighboring vertical antenna elements. This reduces the number of transceiver paths by a factor of two. However, this also significantly reduces the vertical range in which a beam can be directed. Typically, the range is then only +/−10°. Such a vertical range may e.g. be sufficient in rural flat areas.

For a scenario where the massive MIMO antenna is used in urban areas with high rise buildings, this range restriction may be problematic, since e.g. the top of high buildings may be out of reach of the massive MIMO antenna. To cover high rise buildings, it would therefore be better to provide a wide vertical range to direct a beam. This could be achieved by pairing two horizontal antenna elements.

Therefore, two different kinds of antennas are required for the above described different use cases. This is not desired since it would require the build of two different antennas and the logistic that is connected to handle two different antenna models.

Accordingly, there is a need for a more flexible antenna.

SUMMARY OF THE INVENTION

The above stated problem is solved by the features of the independent claims. It is understood, that independent claims of a claim category may be formed in analogy to the dependent claims of another claim category.

Accordingly, it is provided:

An antenna module for a massive MIMO antenna, the antenna module comprising a plurality, i.e. two or more, of first signal ports, a number of first antenna elements arranged in a first matrix arrangement, wherein a number of rows of the first matrix arrangement and/or a number of columns of the first matrix arrangement equals the number of first signal ports, and a switching matrix that is configured to controllably couple each of the first signal ports either with all first antenna elements of a respective row of the first matrix arrangement or all first antenna elements of a respective column of the first matrix arrangement.

Further, it is provided

A massive MIMO antenna comprising a plurality of antenna modules according to the present invention, and a transceiver for every first input port and/or second input port of the antenna modules.

The present invention is based on the finding that with a conventional massive MIMO antenna it is difficult to fulfill the requirements of different application scenarios, like they may be present e.g. in rural areas and in urban areas.

Especially the limited range for beamforming either in vertical or in horizontal direction may pose a problem for network operators that try to fully cover an area with their services. Therefore, two different types of antennas may in some cases be developed to fully satisfy all requirements.

The present invention now tries to satisfy the requirements of different application scenarios of modern massive MIMO antennas in a single antenna. However, instead of simply providing a dedicated transceiver for every single antenna element, the present invention provides a configurable antenna that may be configured according to the applications requirements after production. This means that with the present invention development, testing, production and logistics only need to be provided for a single antenna instead of multiple antennas.

To this end, the present invention provides the antenna modules that may be used in a massive MIMO antenna.

Every single antenna module comprises a plurality of first signal ports. The signal ports serve to couple the single antenna modules to respective transceivers for receiving and transmitting RF signals. Typical antenna modules may e.g. comprise two first signal ports. However, it is also possible for an antenna module to comprise more than two signal ports or even only one signal port. Two respective antenna elements may e.g. be arranged as a 2×1 matrix or vector in the case of only one signal port.

The antenna modules further comprise first antenna elements. Typically, every antenna module may e.g. comprise two first antenna elements for every one of the first signal ports. However, it is understood, that any other number of antenna elements, like e.g. three, four or more first antenna elements may be provided for each of the first signal ports.

The first antenna elements may be arranged in a matrix arrangement, i.e. in rows and columns. For example, with two first signal ports and four first antenna elements, such an arrangement may comprise two rows and two columns, i.e. a 2×2 matrix. It is understood, that the positions, especially the distances, of the single first antenna elements may e.g. mechanically be determined such that they match the operating frequency of the massive MIMO antenna.

The antenna elements according to the present invention further comprise a switching matrix that couples the first signal ports to the first antenna elements. The switching matrix may e.g. be externally controlled such that the first antenna elements of a row or of a column are coupled to the same first signal port. In the above 2×2 example, this would mean, that one first signal port would either be coupled to two vertically neighboring first antenna elements or two horizontally neighboring antenna elements.

As indicated above, in a massive MIMO antenna multiple antenna modules may be installed. Therefore, if e.g. the switching matrices are controlled to couple the first input ports to vertically neighboring antenna elements, every column (in horizontal direction) of the massive MIMO antenna may be provided with an individual signal. However, two rows (in vertical direction) will in this case always be provided with identical signals.

The more first antenna elements may be individually provided with a signal, the sharper the created beam may be. If two elements are paired e.g. in vertical direction as indicated above, the vertical range for beamforming is limited because of the appearance of unwanted so called grating lobes. Typically, the vertical steering range may be about +1-10°. The beam width of the beam that may be created e.g. by an 8×8 antenna element array would be around 14°. This means that the "visible range" of the massive MIMO antenna in the vertical direction would be around 30°. In such a massive MIMO antenna, if the first antenna elements are placed at half the wavelength of the operating signals frequency, the beam may be shifted horizontally by +1-50°. This creates a visible window of the antenna of 120°×30°, taking a beam width into account. Such a window may serve well to provide rural areas with RF communications.

With the present invention the same massive MIMO antenna may also be configured such that the horizontally neighboring first antenna elements are coupled to the same first signal port. Consequently, every row (in vertical direction) of first antenna elements may be provided with individual signals, while pairs of two neighboring columns (in horizontal direction) may be provided with the same signals. In this case, the horizontal steering range may be about +/−10° and the vertical steering range may be about +/−50°. This creates a visible window of the antenna of 30°×120°, taking a beam width into account.

It is understood, that while the above is described in transmission direction, where the first antenna elements are provided with signals via the first signal ports, the above explanations also apply mutatis mutandis to the reception direction.

The present invention therefore provides a massive MIMO antenna that may be flexibly configured to provide either a large vertical steering range or a large horizontal steering range, depending on the applications requirements. At the same time, the massive MIMO antenna of the present invention does not require additional transceivers, but only the switching matrix to couple the first signal ports to the respective first antenna elements. Such a switching matrix comprises a low complexity compared to transceivers and therefore allows providing a simple massive MIMO antenna with high flexibility regarding the beam steering capabilities.

Further embodiments of the present invention are subject of the further subclaims and of the following description, referring to the drawings.

In an embodiment, the antenna module may comprise a plurality, i.e. two or more, of second signal ports, and a number of second antenna elements arranged in a second matrix arrangement, wherein a number of rows of the second matrix arrangement and/or a number of columns of the second matrix arrangement equals the number of second signal ports, and wherein each one of the second antenna elements is arranged as a cross polarized pair with a respective one of the first antenna elements. The switching matrix may further be configured to controllably couple each of the second signal ports either with all second antenna elements of a respective row of the second matrix arrangement or all second antenna elements of a respective column of the second matrix arrangement.

For the above described massive MIMO antenna with only first antenna elements, all first antenna elements may comprise the same polarization.

To increase the capacity of the massive MIMO antenna of the present invention it is further possible to provide the second antenna elements with their corresponding second signal ports. The second antenna elements may be cross-polarized regarding the first antenna elements and may be arranged in pairs with the respective first antenna elements.

The switching matrix may be configured to perform the same coupling between the second signal ports and the second antenna elements as with the first signal ports and the first antenna elements.

Therefore, the second input ports may be coupled to all second antenna elements in a row or a column of the respective antenna module.

It is therefore possible to provide a massive MIMO antenna with cross-polarized antenna elements in each of the antenna modules. Such an arrangement may e.g. comprise identical arrangements with first signal ports with first antenna elements and second signal ports with second antenna elements, but for the polarization of the antenna elements.

In an embodiment, the switching matrix may also be capable of coupling the first signal ports with first antenna elements of single rows of the respective antenna modules, and of coupling the second signal ports with the second antenna elements of single columns of the respective antenna module. This would allow a wide range beamforming in vertical direction with the first antenna elements, and a wide range beamforming in horizontal direction with the second antenna elements.

It is understood, that the switching matrix may also be capable of coupling the first signal ports with first antenna elements of single columns of the respective antenna modules, and of coupling the second signal ports with the second antenna elements of single rows of the respective antenna module. This would allow a wide range beamforming in vertical direction with the first antenna elements, and a wide range beamforming in horizontal direction with the second antenna elements.

In a further embodiment, each of the first signal ports and/or the second signal ports may comprise a signal splitter/combiner that is configured to split a single source upstream signal, i.e. a signal that is directed to the antenna elements, into split upstream signals for the respective antenna elements that the respective first signal port or second signal port is coupled to via the switching matrix, and that is configured to combine two source downstream signals, i.e. signals that are received by the respective antenna elements, received via the respective antenna elements that the respective first signal port or second signal port is coupled to into a single combined downstream signal.

The signal splitter/combiner serves for providing a single source upstream signal from one signal port to a plurality of antenna elements and for providing a single combined downstream signal to the respective signal port from multiple antenna elements. Each signal splitter/combiner is therefore provided specifically for one of the signal ports and may be provided between the respective signal port and the switching matrix.

It is understood, that in the above example of 2×2 antenna modules, each of the signal splitter/combiners may comprise one port for connection to the respective signal port and two ports for connection to the switching matrix and the antenna elements. It is also understood, that in other embodiments, the signal splitter/combiners may comprise more than two ports for connection to the switching matrix and the antenna elements.

In another embodiment, the antenna module may comprise for each signal splitter/combiner at least one phase shifter in at least one signal line between the signal splitter/combiner and the respective first antenna element or second antenna element.

The phase shifters may be provided e.g. between the respective signal splitter/combiner and the switching matrix or between the switching matrix and the respective antenna element.

The phase shifters may serve to add a "static" phase shift to the signal of an antenna element. If for example two vertically neighboring antenna elements are provided with the same signal, the beam will be emitted orthogonally from the antenna module. With the phase shifter a certain degree of tuning of the beam direction becomes possible. The phase shifter may therefore move the "visible area" of the antenna module or a massive MIMO antenna up and down or left and right depending on the state of the switching matrix.

The above term "static" refers to the phase shifter being slow compared to e.g. a frame duration of an LTE frame. This means that the phase shift may e.g. only be modified between two LTE frames and not during the transmission or reception of an LTE frame. It is understood, that with respectively quick phase shifters it may also be possible to adjust the beam steering during an LTE frame. It is further understood, that the LTE frame is just used as an example, and that any other unit of communication in a respective communication system may also be used here.

The phase shifters may e.g. be electrical or mechanical phase shifters. The phase shifting may e.g. be created by switching between different signal paths of different path length. Another possible solution is to change the path length with a motor.

In a further embodiment, the first antenna elements may be positioned half the wavelength of an operating frequency of the antenna module away from each other. In addition, or as alternative, the second antenna elements may be positioned half the wavelength of the operating frequency of the antenna module away from each other.

The distance between the single antenna elements in relation to the frequency of the transmitted or received signals influences the beam forming performance of the massive MIMO antenna. The best beam forming performance may be achieved if the distance of the single antenna elements is exactly half the wavelength of the operating frequency that the massive MIMO antenna is operated with. If the antenna elements are placed at half the wavelength of the operating frequency, the beam may be shifted in the respective direction by about +/−50°.

It is understood, that depending on the communication system in which the massive MIMO antenna is used, an operating frequency range may be used instead of a single operating frequency. In this case a specific frequency in this operating frequency range may be used to determine the distance between the antenna elements. Such a frequency may e.g. be the center frequency of the respective operating frequency range.

In another embodiment, the switching matrix may further be configured to controllably couple each of the first signal ports and each of the second signal ports to the first antenna element and to the second antenna element of a respective one of the cross polarized pairs of antenna elements.

Instead of only pairing first antenna elements or second antenna elements row-wise or column-wise, another possible pairing may involve pairing first and second antenna elements with a single signal port.

Such a pairing or coupling therefore involves pairing cross polarized antenna elements. In this case, the capacity increase through cross polarized antenna elements is not present. On the other side, it provides independent paths for all cross polarized pairs of antenna elements in the massive MIMO antenna. This results in an unrestricted range for beamforming. In certain use cases this scenario may provide better capacity and performance than pairing two adjacent antenna elements.

In a further embodiment, the switching matrix may comprise a plurality of controllable RF switches and a switch controller that is coupled to control inputs of the RF switches and that is configured to control the RF switches based on a control input signal.

Any type of controllable RF switches may be used in the switching matrix. Such RF switches may e.g. comprise traditional RF switches or electronic switching elements, like e.g. transistors or the like. The switch controller serves for establishing an interface that allows controlling the single RF switches externally. For example, an antenna controller may be provided in the massive MIMO antenna that performs general control functions in the massive MIMO antenna. Such an antenna controller may e.g. receive a desired switching state for the switching matrix from the operator's systems, e.g. the operator's core network or any other element. As alternative, such an antenna controller may also be capable of determining the required switching state of the switching matrix by itself.

The switch controller may comprise any type of interface for receiving control signals. Such an interface may e.g. comprise digital or analog signal lines. The interface may e.g. comprise a serial or parallel digital interface. The switch controller may further comprise an individual signal line to every RF switch to control the respective RF switch according to the received control signals.

With the RF switches and the switch controller it is possible to dynamically configure the behavior of the single antenna modules and therefore of the massive MIMO antenna, as required. It is however understood, that direct control of the switching matrix is also possible, i.e. without the switch controller.

This for example allows switching a massive MIMO antenna from a large vertical beamforming range to a large horizontal beamforming range, when required. A possible application may e.g. include a high office building that requires an antenna with a large vertical beamforming range during the working hours. However, outside the working hours, a rather large horizontal beamforming capability may be required since in the upper levels of the building only a small number of people may be present, while many people may be walking on the streets and in stores.

In another embodiment, the switching matrix may comprise a plurality of one-time switching elements, especially trace fuses.

With one-time switches, like e.g. trace-fuses that may be physically destroyed during a configuration step, a very simple switching matrix may be provided that may be one-time controllable. Therefore, the single antenna modules may be provided with a very simple design. Depending on the requirements of the network operator the massive MIMO antenna may therefore be configured e.g. prior to installation in a site. With the one-time switches it is therefore possible to provide a simplified antenna design for the massive MIMO antenna, while at the same time providing the configuration capability for configuring either a large horizontal or a large vertical beamforming range.

In a further embodiment, the length of the signal lines between the first signal ports and/or the second signal ports through the switching matrix to the respective first antenna elements and/or second antenna elements may be equal for all signal lines.

Providing signal lines of equal length is an important requirement also for the switching matrix. Different length signal paths would introduce phase changes in the signals transmitted or received by two paired antenna elements. Therefore, signal lines of different length would negatively influence the beamforming capabilities of the massive MIMO antenna.

In an embodiment, the massive MIMO antenna may comprise sixteen antenna modules, wherein the antenna modules may be arranged in a matrix arrangement comprising four rows and four columns.

Such a massive MIMO antenna would comprise 64 first antenna elements or cross polarized pairs of antenna elements. Therefore, eight first antenna elements or pairs of cross polarized first and second antenna elements would be present in every row and every column of the matrix arrangement.

It is however understood, that any other number of antenna elements may be provided in a massive MIMO antenna. Further, the number of antenna elements in the rows and the columns of the matrix arrangement may be different. For example, two antenna modules, i.e. four first antenna elements or pairs of cross polarized first and second antenna elements, may be arranged in each row, and four or more antenna modules, i.e. eight first antenna elements or pairs of cross polarized first and second antenna elements, may be present in each column.

BRIEF DESCRIPTION OF THE DRAWINGS

For a more complete understanding of the present invention and advantages thereof, reference is now made to the following description taken in conjunction with the accompanying drawings. The invention is explained in more detail below using exemplary embodiments which are specified in the schematic figures of the drawings, in which.

In the figures like reference signs denote like elements unless stated otherwise.

DETAILED DESCRIPTION OF THE DRAWINGS

The antenna modules 100, 200 described below only comprise antenna elements of the same polarization. It is however understood, that the descriptions of antenna modules 100, 200 also apply mutatis mutandis to an embodiment of an antenna module with cross polarized pairs of antenna elements and respective massive MIMO antennas. In this context it is understood, that the first signal ports and the first antenna elements refer to a first polarization and the second signal ports and the second antenna elements refer to a second polarization.

Figure 1:
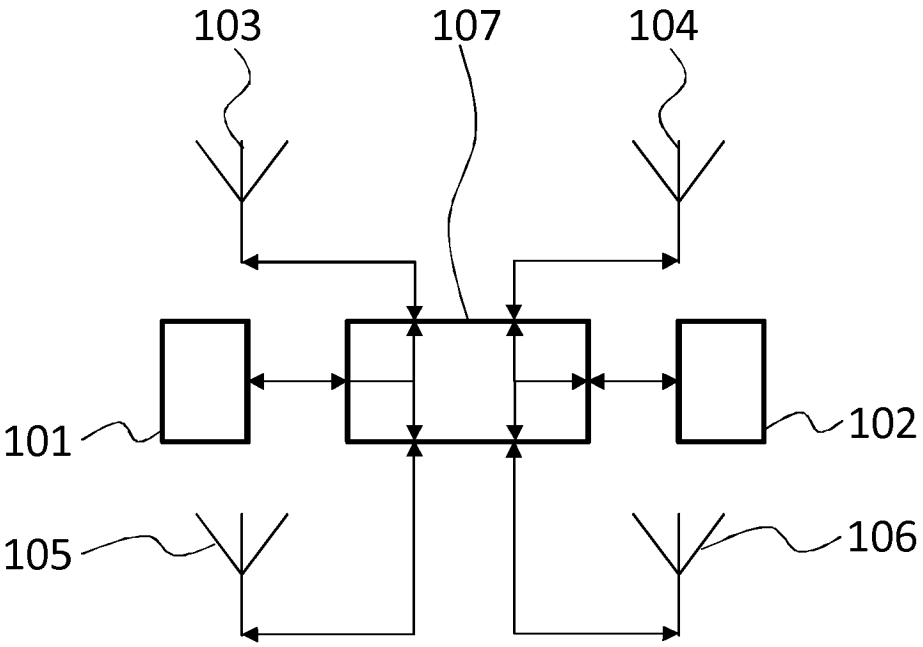
FIG. 1 shows a block diagram of an embodiment of an antenna module according to the present invention.

FIG. 1 shows a block diagram of an antenna module 100. The antenna module 100 comprises two first signal ports 101, 102 and four first antenna elements 103, 104, 105, 106. The first antenna elements 103, 104, 105, 106 are coupled to the first signal ports 101, 102 via a switching matrix 107. It is understood, that the number of four first antenna elements 103, 104, 105, 106 and two first signal ports 101, 102 is just exemplarily chosen and that other embodiments of an antenna module may comprise other numbers of first signal ports and antenna elements. Such an embodiment may for example comprise three first signal ports and nine first antenna elements.

The switching matrix 107 is capable of controllably interconnecting the antenna elements 103, 104, 105, 106 with the first signal ports 101, 102 in different configurations. In FIG. 1 a configuration is shown, in which the first antenna elements 103, 105 are coupled to the first signal port 101, and in which the first antenna elements 104, 106 are coupled to the second signal port 102.

This means, that the first antenna elements 103, 104, 105, 106 are vertically coupled pair-wise. Consequently, the first antenna elements 103, 105 will receive the same upstream signals via first signal port 101 and will provide the received downstream signals both to the first signal port 101. The same applies to first antenna elements 104, 106, which will receive the same upstream signals via first signal port 102 and will provide the received downstream signals both to the first signal port 102.

A massive MIMO antenna may comprise a plurality of antenna modules 100. If all the antenna modules 100 in such an antenna are configured as shown in FIG. 1, every column of first antenna elements 103, 104, 105, 106 may be individually provided with a RF signal. Therefore, beamforming in the horizontal direction may be performed within a large beamforming area of about +/−50°.

Figure 5:
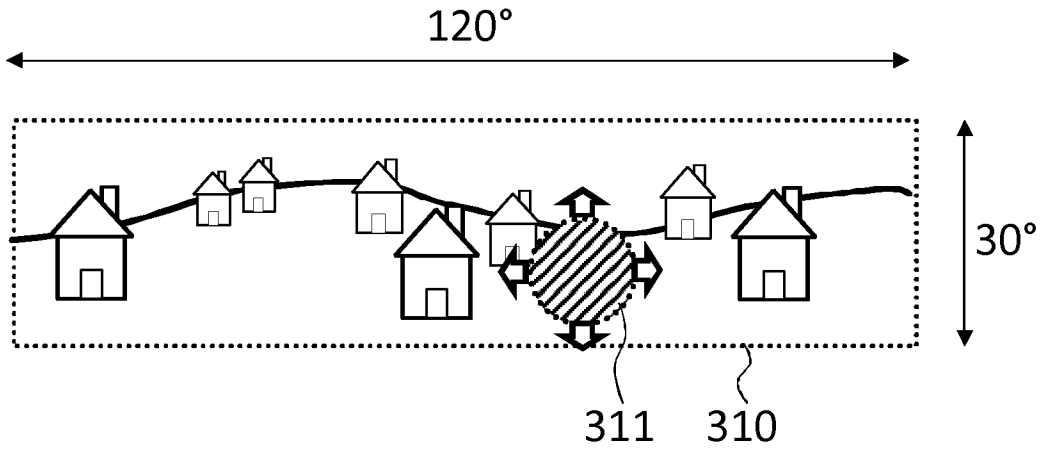
FIG. 5 shows a diagram of a beamforming area of an embodiment of an antenna module according to the present invention.

The configuration of the switching matrix 107 as shown in FIG. 1 may therefore e.g. be advantageously used in rural areas, where low buildings are distributed over the landscape (see e.g. FIG. 5).

Although not explicitly shown, it is understood, that the switching matrix 107 may comprise any number of necessary RF switches or other elements that are required to perform the coupling between the first signal ports 101, 102 and the first antenna elements 103, 104, 105, 106. Such RF switches may e.g. be conventional RF switches, transistors or the like. As alternative, the switching matrix 107 may also comprise one-time controllable switches, like e.g. fuse-traces or the like.

Figure 2:
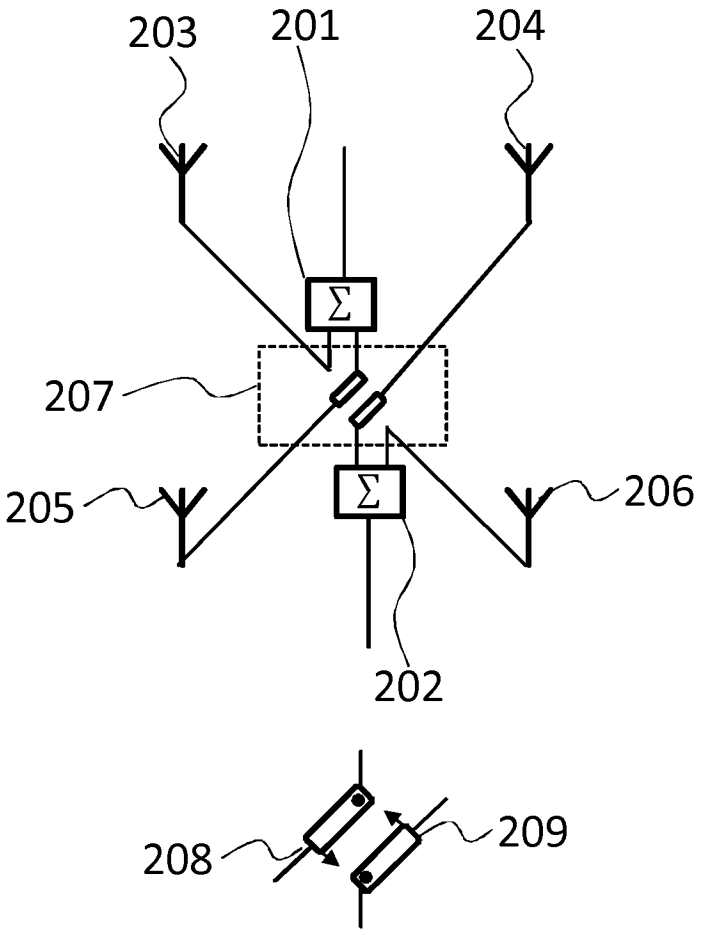
FIG. 2 shows a block diagram of another embodiment of an antenna module according to the present invention.

FIG. 2 shows a block diagram of an antenna module 200. The antenna module 200 is based on the antenna module 100. Therefore, the antenna module 200 comprises two first signal ports 201, 202 that are connected to four first antenna elements 203, 204, 205, 206 via a switching matrix 207. Below the diagram of the antenna module 200, an amplified version of the switches 208, 209 in the switching matrix 207 is shown.

It can be seen in FIG. 2 that only one of the signal lines between the first signal port 201 and the first antenna elements 203, 205 comprises switch 208, i.e. the signal line between first signal port 201 and first antenna element 205. The same applies to first signal port 202 and the first antenna elements 204, 206, where only the signal line between first signal port 202 and the first antenna element 204 comprises switch 209.

Figure 4:
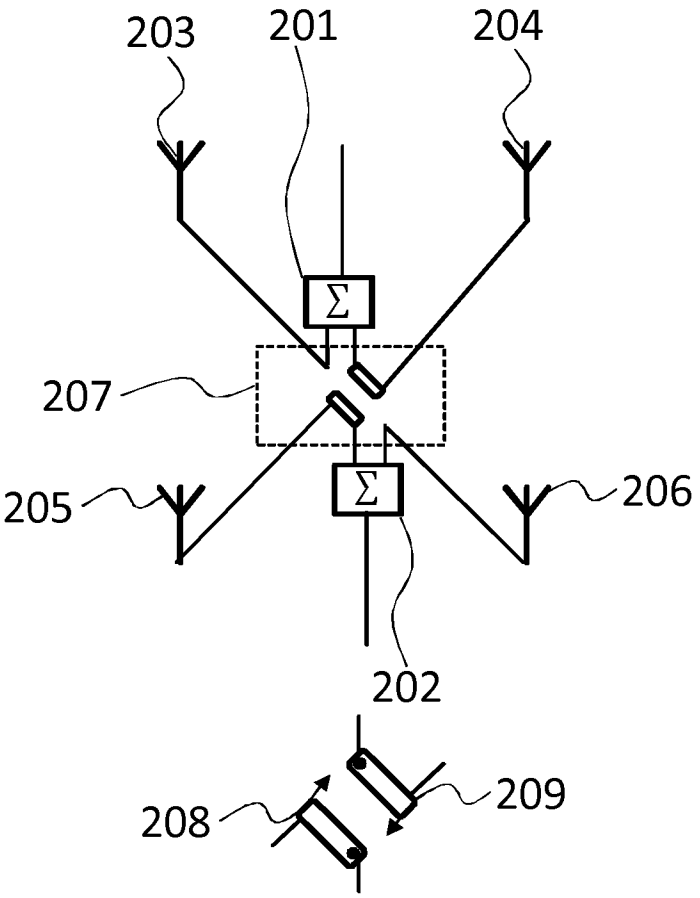
FIG. 4 shows another block diagram of the embodiment of an antenna module according to the present invention of FIG. 2.

As will be seen in FIG. 4, the switch 208 may either couple first antenna element 205 or first antenna element 204 to first signal port. Switch 209 may either couple first antenna element 204 or first antenna element 205 to the first signal port 202.

It can be seen, that the switching matrix 207 of FIG. 2 is in the same configuration as the switching matrix 107 in FIG. 1. This means, that in the shown state of the switching matrix 207, the first antenna element 203 is fixedly coupled to the first signal port 201, and that the first antenna element 205 is coupled to the first signal port 201 via switch 208. In addition, the first antenna element 206 is fixedly coupled to the first signal port 202, and the first antenna element 204 is coupled to the first signal port 202 via switch 208.

Figure 3:
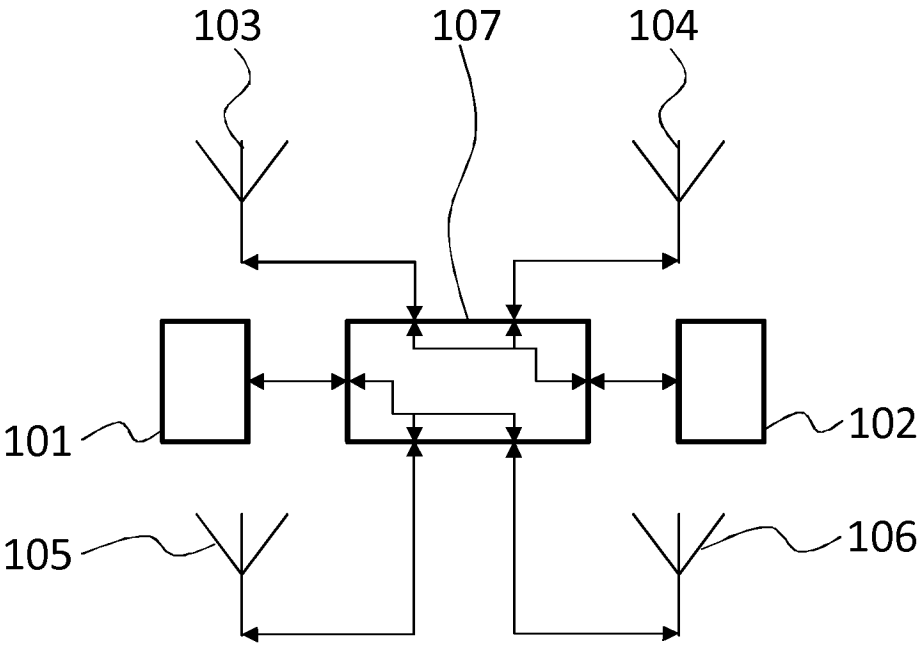
FIG. 3 shows another block diagram of the embodiment of an antenna module according to the present invention of FIG. 1.

FIG. 3 shows another block diagram of the antenna module 100. In FIG. 3, the switching matrix 107 is configured such that the first antenna elements 103, 104 are both coupled to the first signal port 101. The first antenna elements 105, 106 are both coupled to the first signal port 102.

This means, that the first antenna elements 103, 104, 105, 106 are horizontally coupled pair-wise. Consequently, the first antenna elements 103, 104 will receive the same upstream signals via first signal port 101 and will provide the received downstream signals both to the first signal port 101. The same applies to first antenna elements 105, 106, which will receive the same upstream signals via first signal port 102 and will provide the received downstream signals both to the first signal port 102.

A massive MIMO antenna may comprise a plurality of antenna modules 100. If all the antenna modules 100 in such an antenna are configured as shown in FIG. 3, every row of first antenna elements 103, 104, 105, 106 may be individually provided with a RF signal. Therefore, beamforming in the horizontal direction may be performed within a large beamforming area of about +/−50°.

FIG. 4 shows another block diagram of the antenna module 200. For the antenna module 200 the switching matrix 207 is in the same state as the switching matrix 107 of FIG. 3.

Therefore, in the shown state of the switching matrix 207, the first antenna element 203 is fixedly coupled to the first signal port 201, and that the first antenna element 204 is coupled to the first signal port 201 via switch 208. In addition, the first antenna element 206 is fixedly coupled to the first signal port 202, and the first antenna element 205 is coupled to the first signal port 202 via switch 208.

Figure 6:
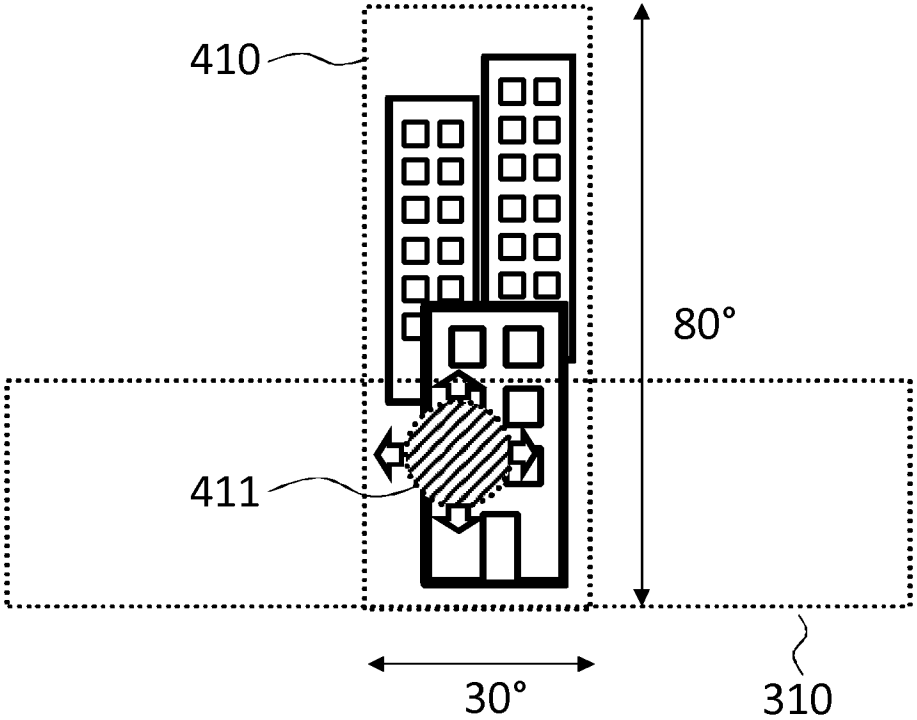
FIG. 6 shows another diagram of a beamforming area of an embodiment of an antenna module according to the present invention.

For sake of simplicity, in the description of the beamforming areas 310, 410 of FIGS. 5 and 6 the reference signs used in the other figures will be used.

FIG. 5 shows a diagram of a possible beamforming area 310 of an antenna module 100, 200, 500.

The beamforming area 310 shows a rather rural landscape with a plurality of buildings (not separately referenced) that are distributed in the landscape in a rather flat fashion.

It is obvious that such a landscape may be adequately provided with wireless communication capabilities by a massive MIMO antenna 620 that provides a horizontally broad coverage area while providing a vertically rather limited coverage area.

In FIG. 5 the coverage area of a massive MIMO antenna 620 is shown, where the switching matrix 107, 207, 507 is configured such that vertically neighboring first antenna elements 103, 104, 105, 106, 203, 204, 205, 206, 503, 504, 505, 506 or second antenna elements 514, 515, 516, 517 are paired. Such a massive MIMO antenna 620 may e.g. provide beam 311 with a width of about 30° and may cover an area of 120° horizontally and 30° vertically.

The configuration of the massive MIMO antenna 620 for this situation may be as shown in FIGS. 1 and 2.

FIG. 6 shows another diagram of a beamforming area 410 of an antenna module 100, 200, 500.

The beamforming area 410 in contrast to the beamforming area 310 shows an urban area. It can be seen, that rather tall buildings (not separately referenced) are present. For ease of understanding, the beamforming area 310 is also shown in FIG. 6. It can be seen, that the beamforming area 310 would not suffice to provide all parts of the shown buildings with adequate coverage.

In the shown example, to supply the tall buildings in the beamforming area 410 a vertical coverage of about 80° would be required. This may be achieved by configuring a massive MIMO antenna 620 to provide a rather large coverage in vertical direction.

The configuration of the massive MIMO antenna 620 for this situation may be as shown in FIGS. 3 and 4.

Figure 7:
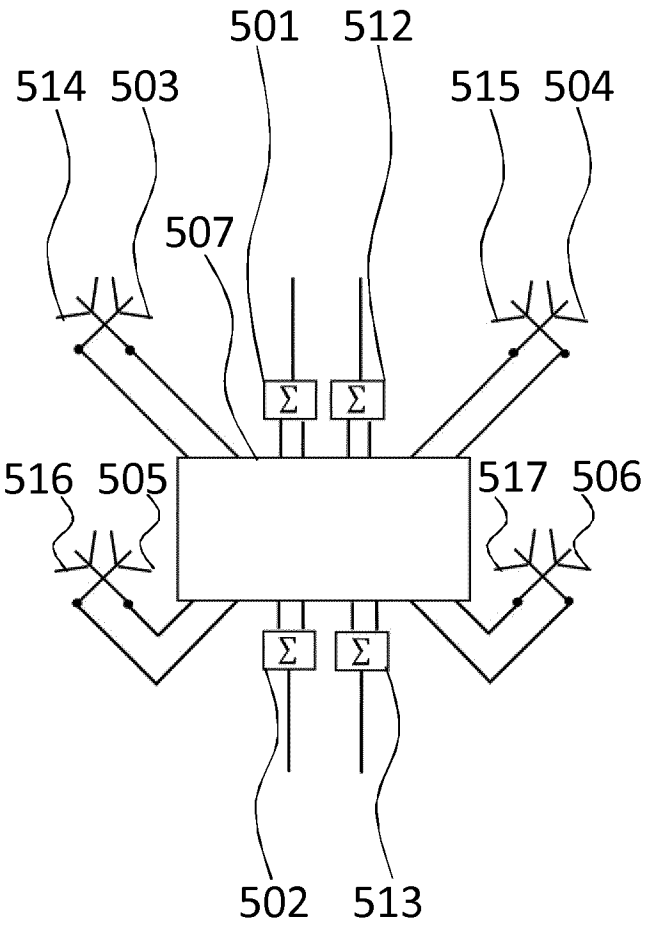
FIG. 7 shows a block diagram of another embodiment of an antenna module according to the present invention.

FIG. 7 shows a block diagram of an antenna module 500. The antenna module 500 is based on the antenna module 100. Therefore, the antenna module 500 comprises first antenna elements 503, 504, 505, 506 that are coupled to first signal input ports 501, 502 via switching matrix 507. In addition to the elements in common with the antenna module 100, the antenna module 500 further comprises second signal ports 512, 513 that are coupled to the switching matrix 507, and second antenna elements 514, 515, 516, 517 that are also coupled to the switching matrix 507.

The second antenna elements 514, 515, 516, 517 are each arranged pair-wise with one of the first antenna elements 503, 504, 505, 506. In these pair-wise arrangements, the single antenna elements 503, 514; 504, 515; 505, 516; 506; 517 are in each case arranged cross polarized to each other.

In an embodiment, all of the first antenna elements 503, 504, 505, 506 may comprise the same polarization, and all of the second antenna elements 514, 515, 516, 517 may comprise the same polarization.

The switching network 507 allows performing different types of interconnections between the first signal input ports 501, 502 and the second signal ports 512, 513. In the following FIGS. 8, 9 and 10, different configurations of the switching network 507 will be shown.

Figure 8:
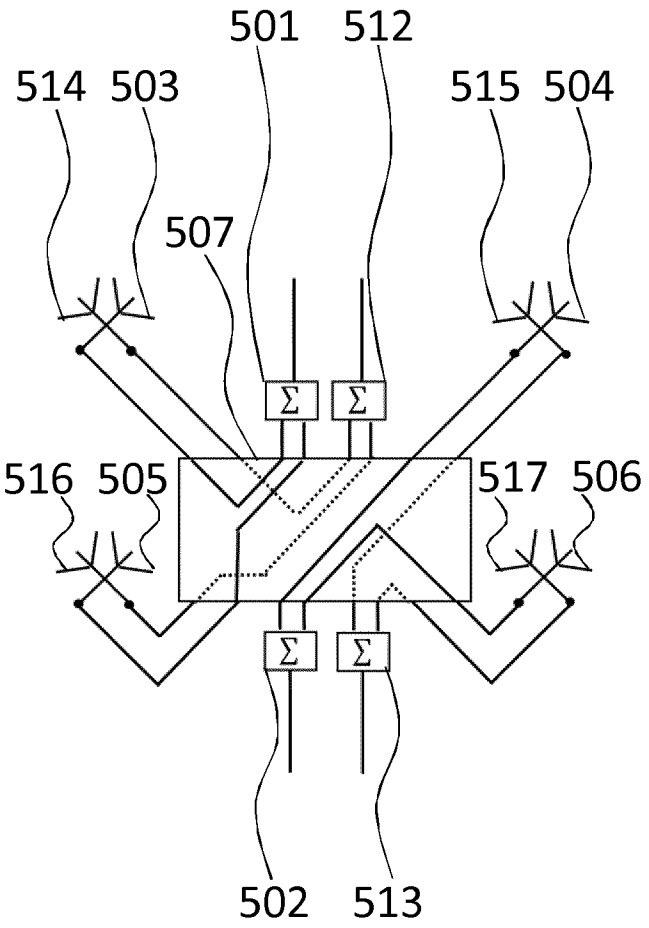
FIG. 8 shows a block diagram of another configuration of the embodiment of an antenna module according to the present invention of FIG. 7.

FIG. 8 shows the antenna module 500. The switching matrix 507 in FIG. 8 is configured such that the first signal input port 501 is coupled to the first antenna elements 503, 505. The first signal input port 502 is coupled to the first antenna elements 504, 506. The second signal port 512 is coupled to the second antenna elements 514, 516, and the second signal port 513 is coupled to the second antenna elements 515, 517.

This arrangement configures the antenna module 500 such that vertically neighboring first antenna elements 503, 505 are coupled to the same first signal input port 501, and first antenna elements 504, 506 are coupled to the same first signal input port 502.

Therefore, a rather broad horizontal coverage may be achieved.

Figure 9:
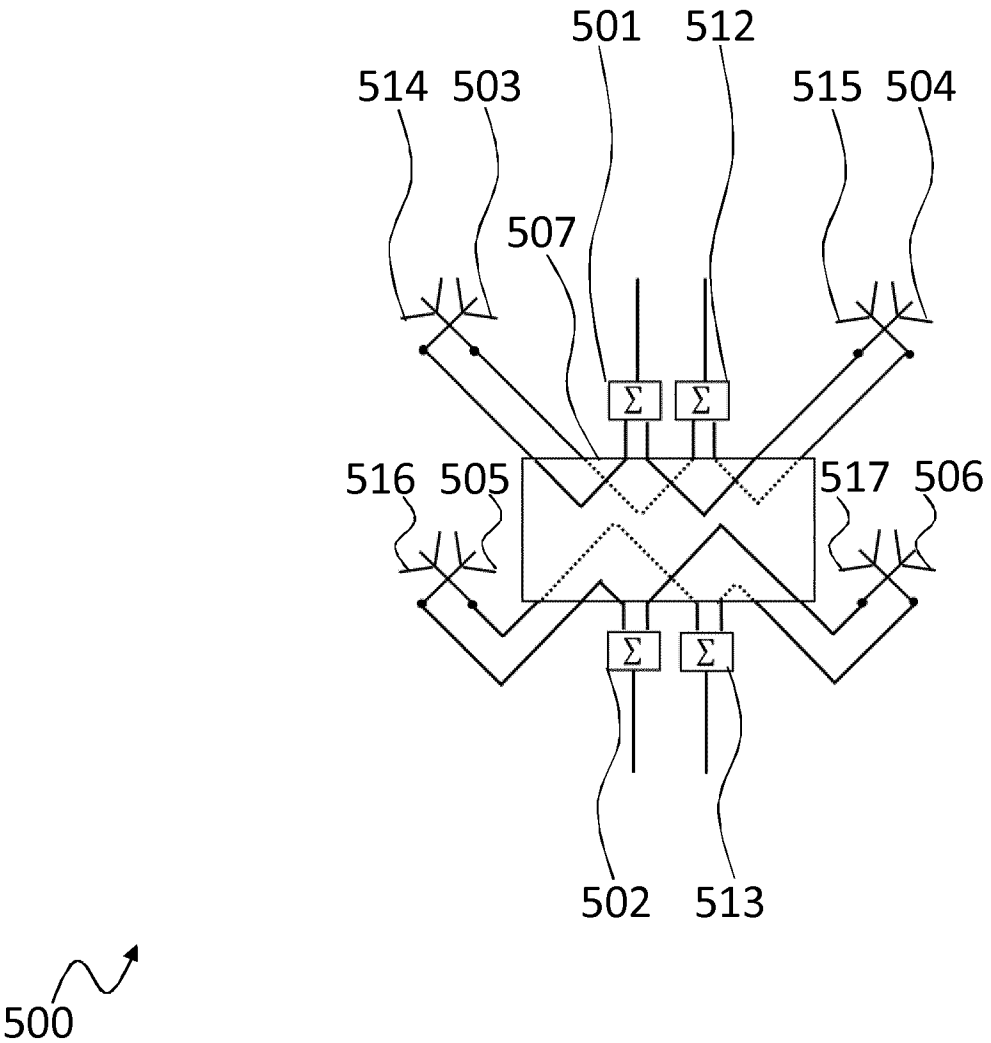
FIG. 9 shows a block diagram of another configuration of the embodiment of an antenna module according to the present invention of FIG. 7.

FIG. 9 also shows the antenna module 500. The switching matrix 507 in FIG. 9 is configured such that the first signal input port 501 is coupled to the first antenna elements 503, 504. The first signal input port 502 is coupled to the first antenna elements 505, 506. The second signal port 512 is coupled to the second antenna elements 514, 515, and the second signal port 513 is coupled to the second antenna elements 516, 517.

This arrangement configures the antenna module 500 such that horizontally neighboring first antenna elements 503, 504 are coupled to the same first signal input port 501, and first antenna elements 5045 506 are coupled to the same first signal input port 502.

Therefore, a rather broad vertical coverage may be achieved.

Figure 10:
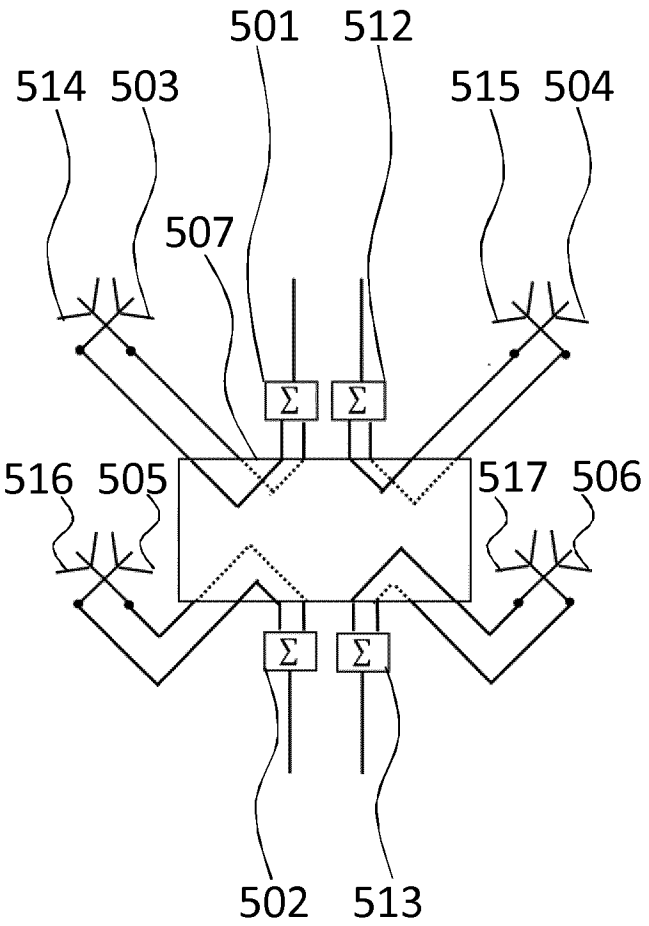
FIG. 10 shows a block diagram of another configuration of the embodiment of an antenna module according to the present invention of FIG. 7.

FIG. 10 also shows the antenna module 500. The switching matrix 507 in FIG. 10 is configured such that the first signal input port 501 is coupled to the first antenna elements 503 and the second antenna element 514. The first signal input port 502 is coupled to the first antenna elements 505 and the second antenna element 516. The second signal port 512 is coupled to the first antenna elements 504 and the second antenna element 515, and the second signal port 513 is coupled to the first antenna elements 506 and the second antenna element 517.

This arrangement configures the antenna module 500 such that the pairs of cross-polarized antenna elements are each coupled to a single one of the signal ports 501, 502, 512, 513.

In this configuration the advantages of cross-polarization will be lost. However, other advantages, i.e. regarding signal strength, may be provided.

Figure 11:
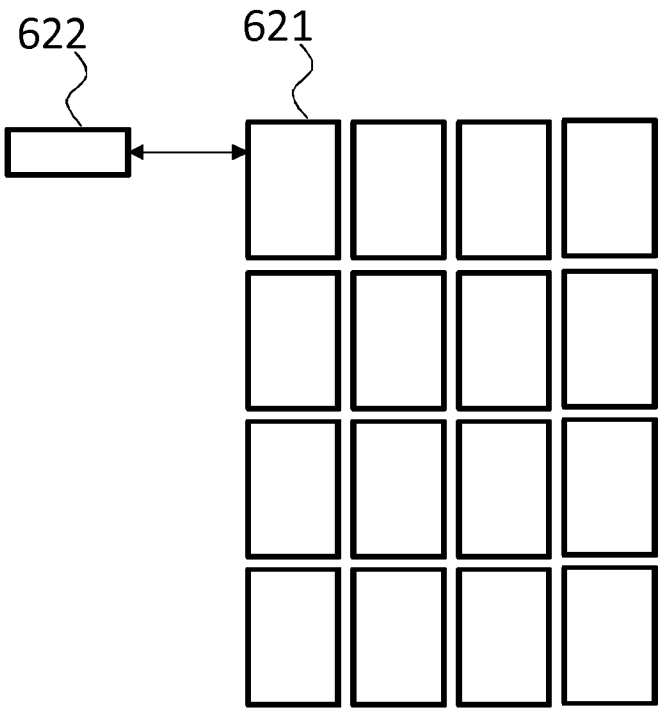
FIG. 11 shows a block diagram of an embodiment of a massive MIMO antenna according to the present invention.

FIG. 11 shows a block diagram of a massive MIMO antenna 620. The massive MIMO antenna 620 comprises an array of 4×4 =16 antenna modules 621 (only the first one is referenced for sake of simplicity). In addition, the massive MIMO antenna 620 comprises for every antenna module 621 transceivers 622. In FIG. 11 the transceivers for antenna module 621 are shown as a single block 622. This block 622 may therefore represent any number, i.e. one or more, of transceivers. The transceivers for the other antenna elements are omitted for sake of clarity.

If for example the antenna modules 621 each comprise four first antenna elements and two first signal ports, two transceivers may be provided for every antenna module 621. The block 622 may therefore represent two transceivers.

If the antenna modules 621 each comprise four first antenna elements, four second antenna elements, two first signal ports, and two second signal ports, four transceivers may be provided for every antenna module 621. The block 622 may therefore represent four transceivers.

It is understood, that any other configuration of the antenna modules 621 may also be supported by the respective number of transceivers.

Although specific embodiments have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

The present invention provides an antenna module 100, 200, 500 for a massive MIMO antenna, the antenna module 100, 200, 500 comprising a plurality of first signal ports 101, 102, 201, 202, 501, 502, a number of first antenna elements 103, 104, 105, 106, 203, 204, 205, 206, 503, 504, 505, 506 arranged in a first matrix arrangement, wherein a number of rows of the first matrix arrangement and/or a number of columns of the first matrix arrangement equals the number of first signal ports 101, 102, 201, 202, 501, 502, and a switching matrix 107, 207, 507 that is configured to controllably couple each of the first signal ports 101, 102, 201, 202, 501, 502 either with all first antenna elements 103, 104, 105, 106, 203, 204, 205, 206, 503, 504, 505, 506 of a respective row of the first matrix arrangement or all first antenna elements 103, 104, 105, 106, 203, 204, 205, 206, 503, 504, 505, 506 of a respective column of the first matrix arrangement. Further, the present invention provides a respective massive MIMO antenna.

LIST OF REFERENCE SIGNS

100, 200, 500 antenna module
621 antenna module
101, 102, 201, 202, 501, 502 first signal port
103, 104, 105, 106, 203, 204, 205, 206 first antenna element
503, 504, 505, 506 first antenna element
107, 207, 507 switching matrix
208, 209 switch
310, 410 beamforming area
311, 411 beam
512, 513 second signal port
514, 515, 516, 517 second antenna element
620 massive MIMO antenna
622 transceivers

The invention claimed is:

1. An antenna module for a massive MIMO antenna, the antenna module comprising:

a plurality of first signal ports, a number of first antenna elements arranged in a first matrix arrangement, wherein a number of rows of the first matrix arrangement and/or a number of columns of the first matrix arrangement equals the number of first signal ports, and a switching matrix that is configured to controllably couple each of the first signal ports either with all first antenna elements of a respective row of the first matrix arrangement or all first antenna elements of a respective column of the first matrix arrangement.

2. The antenna module according to claim 1, comprising:

a plurality of second signal ports, a number of second antenna elements arranged in a second matrix arrangement, wherein a number of rows of the second matrix arrangement and/or a number of columns of the second matrix arrangement equals the number of second signal ports, and wherein each one of the second antenna elements is arranged as a cross polarized pair with a respective one of the first antenna elements, and wherein the switching matrix is further configured to controllably couple each of the second signal ports either with all second antenna elements of a respective row of the second matrix arrangement or all second antenna elements of a respective column of the second matrix arrangement.

3. The antenna module according to claim 1, wherein each of the first signal ports and/or the second signal ports comprises a signal splitter/combiner that is configured to split a single source upstream signal into split upstream signals for the respective antenna elements that the respective first signal port or second signal port (is coupled to via the switching matrix, and that is configured to combine two source downstream signals received via the respective antenna elements that the respective first signal port or second signal port is coupled to into a single combined downstream signal.

4. The antenna module according to claim 3, comprising for each signal splitter/combiner at least one phase shifter in at least one signal line between the signal splitter/combiner and the respective first antenna element or second antenna element.

5. The antenna module according to claim 1, wherein the first antenna elements are positioned half a wavelength of an operating frequency of the antenna module away from each other; and/or wherein the second antenna elements are positioned half the wavelength of the operating frequency of the antenna module away from each other.

6. The antenna module according to claim 2, wherein the switching matrix is further configured to controllably couple each of the first signal ports and each of the second signal ports to the first antenna element and to the second antenna element of a respective one of the cross polarized pairs of antenna elements.

7. The antenna module according to claim 1, wherein the switching matrix comprises a plurality of controllable RF switches and a switch controller that is coupled to control inputs of the RF switches and that is configured to control the RF switches based on a control input signal.

8. The antenna module according to claim 1, wherein the switching matrix comprises a plurality of one-time switching elements.

9. The antenna module according to claim 1, wherein a length of the signal lines between the first signal ports and/or the second signal ports through the switching matrix to the respective first antenna elements and/or second antenna elements is equal for all signal lines.

10. A massive MIMO antenna, comprising a plurality of antenna modules comprising:

plurality of first signal ports, a number of first antenna elements arranged in a first matrix arrangement, wherein a number of rows of the first matrix arrangement and/or a number of columns of the first matrix arrangement equals the number of first signal ports, and a switching matrix that is configured to controllably couple each of the first signal ports either with all first antenna elements of a respective row of the first matrix arrangement or all first antenna elements of a respective column of the first matrix arrangement, and a transceiver for every first input port and/or second input port of the antenna modules.

11. The massive MIMO antenna according to claim 10, comprising 16 antenna modules, wherein the antenna modules are arranged in a matrix arrangement comprising four rows and four columns.

12. The massive MIMO antenna according to claim 10, wherein each of the first signal ports and/or the second signal ports comprises a signal splitter/combiner that is configured to split a single source upstream signal into split upstream signals for the respective antenna elements that the respective first signal port or second signal port is coupled to via the switching matrix, and that is configured to combine two source downstream signals received via the respective antenna elements that the respective first signal port or second signal port is coupled to into a single combined downstream signal.

13. The massive MIMO antenna according to claim 12, comprising for each signal splitter/combiner at least one phase shifter in at least one signal line between the signal splitter/combiner and the respective first antenna element or second antenna element.

14. The massive MIMO antenna according to claim 10, wherein the first antenna elements are positioned half a wavelength of an operating frequency of the antenna module away from each other; and/or wherein the second antenna elements are positioned half the wavelength of the operating frequency of the antenna module away from each other.

15. The massive MIMO antenna according to claim 12, wherein the switching matrix is further configured to controllably couple each of the first signal ports and each of the second signal ports to the first antenna element and to the second antenna element of a respective one of cross polarized pairs of antenna elements.

16. The massive MIMO antenna according to claim 10, wherein the switching matrix comprises a plurality of controllable RF switches and a switch controller that is coupled to control inputs of the RF switches and that is configured to control the RF switches based on a control input signal.

17. The massive MIMO antenna according to claim 10, wherein the switching matrix comprises a plurality of one-time switching elements.

18. The massive MIMO antenna according to claim 10, wherein a length of the signal lines between the first signal ports and/or the second signal ports through the switching matrix to the respective first antenna elements and/or second antenna elements is equal for all signal lines.

19. The antenna module according to claim 4, wherein the first antenna elements are positioned half a wavelength of an operating frequency of the antenna module away from each other; and/or wherein the second antenna elements are positioned half the wavelength of the operating frequency of the antenna module away from each other.

20. The antenna module according to claim 6, wherein the switching matrix comprises a plurality of one-time switching elements, the plurality of one-time switching elements comprising trace fuses.

* * * * *